US005608916A

United States Patent [19]

Aumann

[11] Patent Number: 5,608,916

[45] Date of Patent: Mar. 11, 1997

[54] INSERTED POCKET OF A WATERPROOF GARMENT

[76] Inventor: Hans Aumann, Bergham 2, D-8206 Bruckmuhl, Germany

[21] Appl. No.: 645,882

[22] Filed: May 14, 1996

Related U.S. Application Data

[63] Continuation of Ser. No. 166,975, Dec. 14, 1993, abandoned.

[30] Foreign Application Priority Data

Dec. 15, 1992 [DE] Germany ..... 92 17 078 U

[51] Int. Cl.[6] ..... A41D 27/00; A41D 27/20

[52] U.S. Cl. ..... 2/247; 2/82; 2/94; 2/97; 2/248

[58] Field of Search ..... 2/82, 69, 69.5, 2/94, 88, 89, 97, 247, 248, 249, 250, 251, 252, 253, 254

[56] References Cited

U.S. PATENT DOCUMENTS

| | | | |
|---|---|---|---|
| 2,042,282 | 5/1936 | Tworoger | 2/247 |
| 2,165,081 | 7/1939 | Wald | 2/247 |
| 3,018,486 | 1/1962 | Bukspan | 2/247 |
| 3,085,254 | 4/1963 | Cutler | 2/247 |
| 4,464,798 | 8/1984 | Livingstone | 2/247 |

*Primary Examiner*—Jeanette E. Chapman
*Attorney, Agent, or Firm*—John S. Campbell

[57] ABSTRACT

An inserted pocket system for use with a waterproof garment having a face fabric is provided and includes a waterproof bag-shaped pocket insert having a waterproof bag, an inner pocket part located at the backing of the garment face fabric and an outer pocket part which projects from an insertion opening and a pocket flap which covers the insertion opening. The pocket system is installed within the garment in such a way as to keep contents within the pocket free from moisture.

7 Claims, 1 Drawing Sheet

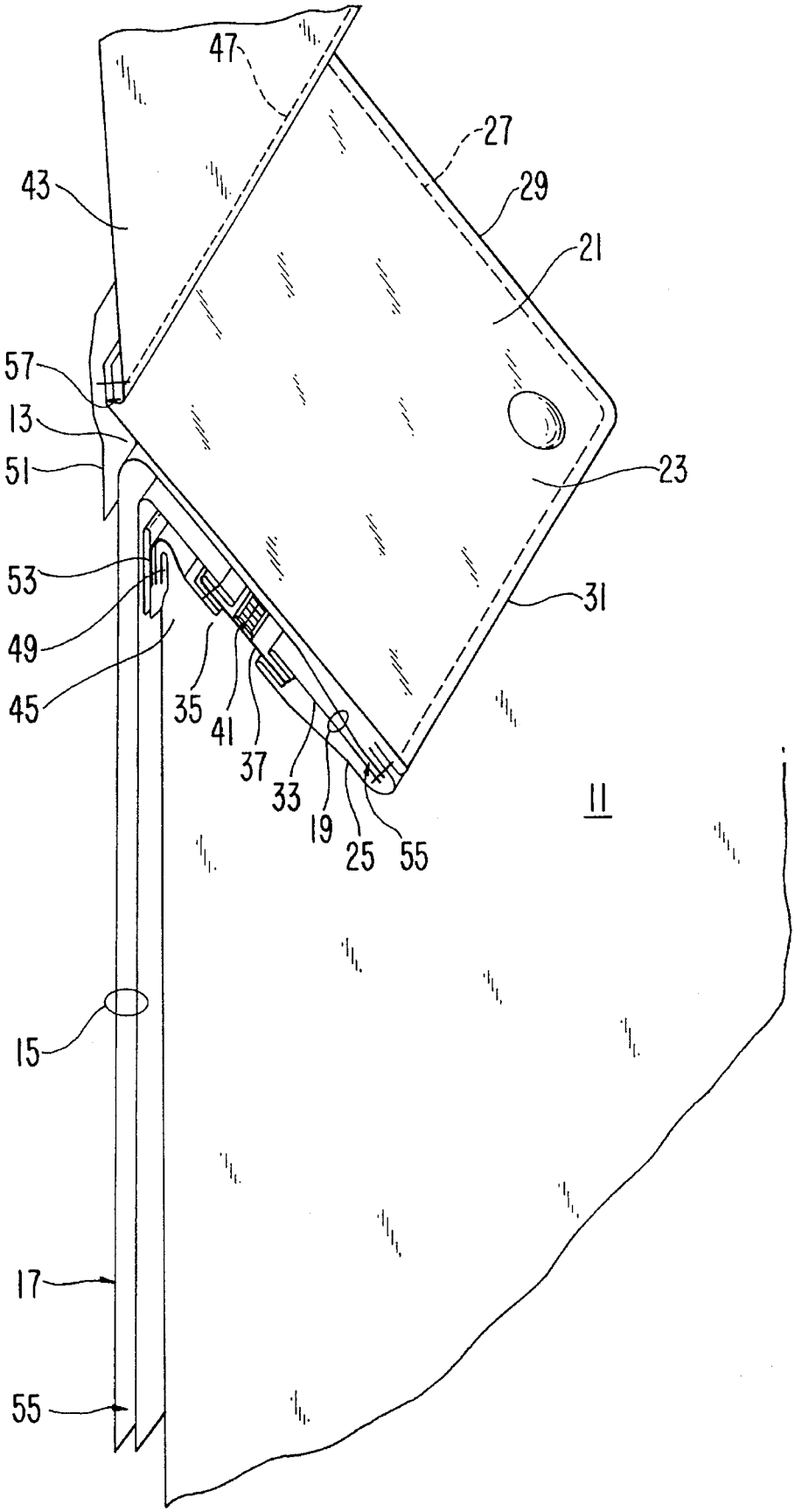
47
27
29
43
21
57
13
51
23
53
31
49
45
35
41
37
33
19
25
55
11
15
17
55

INSERTED POCKET OF A WATERPROOF GARMENT

This application is a continuation of application Ser. No. 08/166,975 filed Dec. 14, 1993, now abandoned.

FIELD OF THE INVENTION

This invention relates to an inserted pocket for a garment that is preferably waterproof. It is particularly useful in garments such as jackets and coats.

BACKGROUND OF THE INVENTION

Many types of outerwear garments such as coats, jackets and anoraks (parkas) are commercially available. Typically, a waterproof outerwear garment is made from a face fabric in the form of a laminate which includes a waterproof functional layer, with a bag-shaped pocket insert located at the inside of the face fabric (seen from the wearer's direction), and which is accessible through an insertion opening of in the face fabric from outside of the garment and has a pocket flap which covers the insertion opening of the face fabric from the outside, and which is attached to the face fabric above the insertion opening of the face fabric on the pocket flap.

In order to increase wear comfort, waterproof garments are nowadays often also designed as breathable garments. For this purpose, a textile material which is permeable to air and water vapor, but also permeable to water, is used as a face fabric. On the backing side of the face fabric there is a membrane or functional layer made of a waterproof, yet water-vapor permeable material. Expanded polytetrafluoroethylene (PTFE) that has been treated with a hydrophilic material such as that described in U.S. Pat. No. 4,194,041, is a material particularly well suited for this purpose. Water as well as wind which penetrate the face fabric is kept away from the wearer's body by the functional layer, whereas water vapor, which is produced when the body sweats, escapes outside through the functional layer.

To ensure waterproofness, the functional layer must be kept free from water permeable spots, such as, but not limited to, needle holes produced during sewing, and pocket opening areas.

One type of garment popular today has a liner called a "Z-liner", which means that the functional layer is loosely hung inside the outer garment. The Z-liner is mainly suitable for garments having a lining separate from the face material, wherein the Z-liner is loosely mounted between the face fabric and the lining. Such garments include coats, anoraks and jackets.

The Z-liner method is less suitable for light garments, such as bicycle jackets, light rain jackets and wind breakers, which are not intended to keep the wearer warm or which are intended for use in the summer and thus have a minimum packing volume. For such garments a two-layer laminate having a textile face material and a functional layer or a three-layer laminate having the two-layer laminate and also a lining material on the backside of the functional layer are used.

Such laminates are processed by existing technology as if they were a single textile layer. Here the laminate pieces are cut to size to produce a garment and then sewn together. Needle holes produced by sewing are then sealed by means of waterproof seam sealing tapes.

Insert pockets or pocket bags are found on the backing side of the face fabric into which the wearer reaches by putting his hand through an insertion opening in the face fabric. This insertion opening is frequently closed by means of a pocket flap. These insert pockets or pocket bags have turned out to be problematic. In a Z-liner design, the pocket contents are exposed to moisture if the pocket bag consists of a water permeable material. A pocket bag consisting of a waterproof material will not protect the pocket contents either because water which reaches the pocket insertion opening can reach the interior of the pocket bag through the insertion opening. This may happen despite a pocket flap if water is driven under the pocket flap by wind.

In a laminate design, water on the garment may creep along the face fabric of the laminate under the pocket flap into the insertion opening from where it will wick into the pocket bag. What is particularly uncomfortable is the fact that moisture may creep from the pocket bag to the wearer's body. Such a wicking effect may be, at least partly, eliminated by applying a water-repellant finish to the face fabric. This is, however, of no avail against wind-driven water.

There is a need for a pocket insert which prevents water from entering and exposing contents within the pocket to moisture.

SUMMARY OF THE INVENTION

An inserted pocket system for use with a waterproof garment having a face fabric is provided and includes a waterproof bag-shaped pocket insert having a waterproof bag, an inner pocket part located at the backing of the garment face fabric and an outer pocket part which projects from an insertion opening and a pocket flap with at least one outer pocket flap layer which covers the insertion opening from the outside and is attached to the face fabric and wherein the outer pocket part of the insert is connected to the outside of the pocket flap and that the inside of the outer pocket part incorporates a pocket insertion opening which is provided with an openable closure device.

The incorporation of a functional waterproof, water vapor permeable layer into the pocket and pocket flap is preferred.

BRIEF DESCRIPTION OF THE FIGURE

The FIGURE provides a sectional schematic view of the inventive inserted pocket.

DETAILED DESCRIPTION OF PREFERRED EMBODIMENTS

A pocket insert system comprising an inner pocket part located at the backing of the garment face fabric and an outer pocket part which projects from the insertion opening in the garment face fabric is provided. The outer pocket part has a length and width which are at a maximum the dimensions of the length and width of the pocket flap. The outer side of the outer pocket part is connected with the inside of the pocket flap and the inside of the outer pocket part incorporates a pocket insertion opening which is provided with an openable closure device. In the closed state, this device is waterproof.

In such a pocket water which creeps along the face material of the face fabric laminate or pocket flap laminate or which is driven there by wind will have no access to the interior of the pocket bag and cannot reach the wearer's body via the pocket bag.

It is particularly preferred to incorporate a functional layer into the pocket flap, too, in particular in the form of a laminate with a face fabric which is similar to or the same as that of the garment and/or pocket flap. A material which is only waterproof but not water vapor permeable would make the garment non-breathable over a surface as large as the pocket flap. No perspiration vapor could be given off from the wearer's body through this surface.

The invention is best understood by reference to the accompanying figure which shows a part of a garment 11 whose face fabric consists of a two-layer laminate. A three-layer laminate is equally suitable. The two-layer laminate incorporates a textile face material on its outer side facing away from the garment wearer's body and a functional layer consisting of a waterproof and water vapor permeable material on its backing side. The three-layer laminate additionally incorporates a textile inner layer on its inner side facing away from the face material. Such laminates are well known in the garment industry and commercially available from W. L. Gore & Associates, Inc.

The garment face fabric is provided with a garment insertion opening 13 through which the interior of a pocket insert or pocket bag 15 can be accessed. The pocket bag 15 consists of a two-piece laminate which is adhesively bonded or seam sealed at least on three of its four circumferential edges. The pocket being created by the space between the two layers of pocket bag 15. The pocket bag 15 comprises an interior pocket part 17 located on the backing side of the garment face fabric and an outer pocket part 19 projecting through the garment insertion opening 13 out of the garment face fabric. A pocket flap 21 covers both the garment insertion opening 13 and the outer pocket part 19. In the preferred embodiment, the laminate parts of the pocket bag 15 consist of the same or a similar laminate as the face fabric.

The pocket flap 21 is provided with an outer pocket flap layer 23 and an inner pocket flap layer 25. Both consist of the same or a similar laminate as the garment face fabric. The length and the width of the pocket flap 21 are such that the pocket flap 21 covers the outer pocket part 19. The outer pocket part 19 is located between the inner pocket flap layer 25 and the outer pocket flap layer 23. The two layers 23 and 25 of the pocket flap 21 and the two layers of the outer pocket part 19 are sewn together by means of a seam 27 which surrounds the pocket flap in the form of a turnover seam along the two pocket flap sides 29 and the free longitudinal end 31 of the pocket flap.

The inner layer 25 of the pocket flap and the outer layer 23 of the pocket flap may be designed as one piece wherein both layers 23 and 25 are formed by turnovers at the free longitudinal end 31 of the pocket flap. The part of the seam 27 surrounding the pocket flap located there serves to connect the free longitudinal ends of the pocket flap 21 to the outer pocket part 19.

The inner layer 25 of the pocket flap and the inner layer 33 of the outer pocket part 19 are provided with a flap insertion opening 35 and a pocket mouth 37 respectively. Both are equipped with a closure device which can be opened and which is waterproof when closed, in the embodiment shown in the figure is in the form of a waterproof zipper 41 (commercially available from BDM GmbH of Germany) with whose two lateral textile strips the edges of the flap insertion opening 35 and the pocket mouth 37 are sewn together. Waterproof zippers are also commercially available from many other manufacturers.

The ends of the outer layer 23 and the inner layer 25 of the pocket flap facing towards the insertion opening 13 are sewn together with the upper edge 43 and the lower edge 45 of the insertion opening 13 in the garment face fabric respectively. In the embodiment this is accomplished by means of one upper backstitch seam 47 and one lower backstitch seam 49. Both backstitch seams 47 and 49 each go through the functional layer of the garment face fabric and are therefore sealed on the side facing the wearer's body with one upper seam sealing tape 51 and one lower seam sealing tape 53.

The circumferential sealed seam 55 may be slightly staggered backwards relative to the circumferential edge of the pocket bag 15. Therefore the sealed seam 55 is surrounded by an edge area in which the laminate parts of the pocket bag 15 are not linked with each other. The non-linked edge areas alongside the lateral edges of the pocket bag 15 are cut where the inside and the outside of the inner pocket part 17 are adhesively bonded to the upper seam sealing tape 51 and the lower seam sealing tape 53 respectively, from the circumferential edge of the pocket bag 15 up to the sealed seam 55 in order to prevent the formation of canals on the inside of the seam sealing tapes 51 and 53 which could conduct water into the garment. The sealed seam 55 may also be a glued seam.

The parts of the seam tapes 51 and 53 which extend on both sides of the pocket flap 21 are glued on top of one another. To ensure that the inner pocket part 17 can be swivelled unhindered relative to the garment face fabric, (e.g. with the garment insertion opening in the face fabric as the swivelling axis), the upper seam tape 51 and the lower seam tape 53 are cut along the lateral edges of the pocket bag 15 up to the transition between the inner pocket part 17 and the outer pocket part 19.

The pocket of the invention is integrated as follows:

At first the zipper 41 is integrated into the flap insertion opening 35 and the pocket insertion opening 37. Subsequently the edge of the outer layer 23 of the pocket flap is turned over and sewn to the turned over outer layer of the outer pocket part 19. The outer layer 23 of the pocket flap is then turned over and sewn with a partition seam 57 to the upper edge 43 of the garment insertion opening 13 in the face fabric. The upper edge 43 and the lower edge 45 of the garment insertion opening 13 in the face fabric are then sewn together at the adequate height and stitched by a backstitch seam 47. The pocket flap 21 must not be held by this backstitch seam except for the area outside the lateral glued seams 55 of the pocket bag 15. The pocket bag 15 is cut out at both lateral edges in the area of the seam sealing tapes 51 and 53 up to the glued seam so that the seam tapes 51 and 53 meet with the glued seam 55 and the formation of water-conducting canals on both sides of the pocket bag 15 is prevented. The pocket bag 15 is then turned upwards in the garment 11 and sealed together with the garment area 11 located below the insertion opening 13 in the garment face fabric by the lower seam tape 53. At the areas where the lower seam tape 53 would attach the pocket bag 15 in the upwards direction, the lower seam tape 53 is cut up to about the middle of its width. Subsequently the pocket bag 15 is placed back downwards in the garment 11 and the upper seam tape 51 is applied.

I claim:

1. A waterproof garment comprising:

(a) a face fabric having an innersurface and an outer surface with a waterproof functional layer laminated to its inner surface;

(b) a waterproof bag shaped pocket, a portion of which is located on the inner side of said face fabric and a portion of which extends into a pocket flap which covers an opening in said face fabric that is adapted to receive that portion of the pocket that is located with the face fabric, said pocket flap having an outer part that is attached to the outer surface of said face fabric and an inner part also attached to the outer surface of said face fabric and having an openable closure device, said portion of said pocket extending into said pocket part being located between said inner and outer parts of said pocket flap and attached thereto by a waterproof seam.

2. The garment of claim 1 in which said closure device is waterproof in the closed state.

3. The garment of claim 1 which said pocket comprises two layers, an upper and a lower layer, said layers being attached at their edges by a waterproof seam to provide a pocket said lower layer being attached to said openable closure device.

4. The garment of claim 3 in which said upper and said lower layers each comprising a face fabric with a waterproof functional layer laminated to said face fabric.

5. The garment of claim 3, wherein said attachment is by a circumferential seal.

6. The garment of claim 1 in which at least the waterproof functional layer laminated to said face fabric is permeable to water vapor.

7. The garment of claim 3 in which all said waterproof functional layers are permeable to water vapor.

* * * * *